US011776523B2

(12) United States Patent
Suetsugu

(10) Patent No.: US 11,776,523 B2
(45) Date of Patent: Oct. 3, 2023

(54) SOUND INSULATION APPARATUS

(71) Applicant: Katsunori Suetsugu, Tokyo (JP)

(72) Inventor: Katsunori Suetsugu, Tokyo (JP)

( * ) Notice: Subject to any disclaimer, the term of this patent is extended or adjusted under 35 U.S.C. 154(b) by 0 days.

(21) Appl. No.: 17/805,935

(22) Filed: Jun. 8, 2022

(65) Prior Publication Data

US 2022/0399003 A1 Dec. 15, 2022

(30) Foreign Application Priority Data

Jun. 10, 2021 (JP) ..... 2021-096986

(51) Int. Cl.
*G10K 11/175* (2006.01)
*E04B 1/82* (2006.01)

(52) U.S. Cl.
CPC ..... *G10K 11/1752* (2020.05); *E04B 1/8218* (2013.01)

(58) Field of Classification Search
CPC ..... G10K 11/1752; E04B 1/8218
See application file for complete search history.

(56) References Cited

U.S. PATENT DOCUMENTS

2017/0256250 A1* 9/2017 Krasnov ..... G10K 11/1752
2018/0268835 A1* 9/2018 Krasnov ..... H04K 3/41
2020/0370318 A1 11/2020 Uetabira et al.

FOREIGN PATENT DOCUMENTS

JP 2012008391 A * 1/2012
JP 2012-082616 A 4/2012
JP 2012132966 A * 7/2012
JP 2013-162212 A 8/2013
JP 2020-190151 A 11/2020
JP 3231591 U * 4/2021
KR 20200117705 A * 10/2020

OTHER PUBLICATIONS

JPO, Japanese Office Action dated Sep. 14, 2021 in Japanese Patent Application No. 2021-096986, 6 pages with English translation.

* cited by examiner

*Primary Examiner* — David L Ton
(74) *Attorney, Agent, or Firm* — MASUVALLEY & PARTNERS; Peter R. Martinez

(57) ABSTRACT

In the sound insulation apparatus, a sound wave transmitter configured to transmit sound waves with frequencies including the frequencies of propagation sound waves from a sound source and a sound wave receiver configured to receive the sound waves transmitted from the sound wave transmitter are coupled such that the orientation of a sound wave transmission surface of the sound wave transmitter and the orientation of a sound wave receiving surface of the sound wave receiver intersect each other and one pair set is formed. The one pair set is disposed in plurality such that the sound wave transmission surface of one set is spaced from and opposed to the sound wave receiving surface of another set and a space surrounding the sound source is formed. The sound waves transmitted from each of the sound wave transmitters are mixed with the propagation sound waves.

19 Claims, 9 Drawing Sheets

SOUND INSULATION APPARATUS

CROSS-REFERENCE TO RELATED APPLICATION

This application claims priority to Japanese Patent Application No. 2021-96986 filed on Jun. 10, 2021, which is hereby incorporated herein by reference in its entirety.

TECHNICAL FIELD

The present invention relates to a sound insulation apparatus.

BACKGROUND ART

A mobile terminal booth is known that includes a sound absorbing panel that forms a mobile phone use space inside the panel by partitioning a space in a plan view, a speaker disposed toward the outside of the use space, and a masking sound generator that causes the speaker to generate masking sounds having a masking function of attenuating high frequencies (Japanese Unexamined Patent Application Publication No. 2020-190151).

A partition panel is also known that includes a partition panel body having a height such that the partition panel body does not contact the ceiling when the partition panel body is installed on the floor and including a first wall and a second wall opposed to the first wall and sound emission means disposed between the first wall and second wall of the panel body and configured to convert supplied masking sound signals into sound waves and to output the sound waves, wherein the emission position through which sound waves outputted from the sound emission means are emitted out of the panel body is located above the panel body, and wherein a shield for shielding a propagation path passing through a space having the first wall of the panel body as a partition and an upper space located above the space among the propagation paths of the sound waves from the emission position is provided (Japanese Unexamined Patent Application Publication No. 2012-82616).

Japanese Patent Laid-Open No. 2020-190151

Japanese Patent Laid-Open No. 2012-82616.

SUMMARY OF INVENTION

An object of the present invention is to provide a sound insulation apparatus that is able to make speeches or details of a conversation in a space difficult to hear outside the space and that can be installed with ease and at low cost.

To solve the above problem, in a sound insulation apparatus according to a first aspect of the present invention, a sound wave transmitter configured to transmit sound waves with frequencies including the frequencies of propagation sound waves from a sound source and a sound wave receiver configured to receive the sound waves transmitted from the sound wave transmitter are coupled such that the orientation of a sound wave transmission surface of the sound wave transmitter and the orientation of a sound wave receiving surface of the sound wave receiver intersect each other and one pair set is formed. The one pair set is disposed in plurality such that the sound wave transmission surface of one set is spaced from and opposed to the sound wave receiving surface of another set and a space surrounding the sound source is formed.

According to a second aspect of the present invention, in the sound insulation apparatus according to the first aspect of the present invention, the one pair set disposed in plurality may be disposed such that the sound wave transmission surface of one set is spaced from and opposed to the sound wave receiving surface of another set, and the sound waves transmitted from each of the sound wave transmitters may be mixed with the propagation sound waves so that the propagation sound waves become difficult to hear outside the space.

According to a third aspect of the present invention, in the sound insulation apparatus of the first or second aspect of the present invention, the sound wave receiver may be disposed in plurality so as to be spaced from each other, and multiple sound wave transmission surfaces may form an angle in the sound wave transmitter so as to intersect each other so that the sound wave transmitter transmits the sound waves to the sound wave receiving surfaces of the sound wave receivers opposed to the sound wave transmitter.

According to a fourth aspect of the present invention, in the sound insulation apparatus of the third aspect of the present invention, one of the sound wave receivers spaced from each other may be disposed outside the space with respect to the other sound wave receiver.

According to a fifth aspect of the present invention, in the sound insulation apparatus of the third aspect of the present invention, one of the sound wave receivers spaced from each other may be disposed inside the space with respect to the other sound wave receiver.

According to a sixth aspect of the present invention, in the sound insulation apparatus of any one of the first to fifth aspects of the present invention, the sound wave transmitter and the sound wave receiver may be columnar bodies extending in a direction intersecting the travel directions of the sound waves, and multiple super-directional speakers configured to output the sound waves using ultrasound as a carrier wave may be arranged in the sound wave transmitter along the length direction of the columnar body.

According to a seventh aspect of the present invention, in the sound insulation apparatus of any one of the first to sixth aspects of the present invention, the sound wave transmitter and the sound wave receiver may be further disposed above the space so as to be opposed to each other and cover the space.

To solve the above problem, in a sound insulation apparatus according to an eighth aspect of the present invention, a sound wave transmitter configured to transmit sound waves with frequencies including the frequencies of propagation sound waves from a sound source and a sound wave receiver configured to receive the sound waves transmitted from the sound wave transmitter are disposed so as to be opposed to each other and form a space surrounding the sound source. The sound wave transmitter and the sound wave receiver are arch-shaped bodies curved in a direction intersecting the travel directions of the sound waves. Multiple super-directional speakers configured to output the sound waves using ultrasound as a carrier wave are arranged in the sound wave transmitter along the curved direction of the arch-shaped body.

According to a ninth aspect of the present invention, in the sound insulation apparatus of the eighth aspect of the present invention, multiple super-directional speakers configured to output the sound waves using ultrasound as a carrier wave may be arranged on radially curved inner surfaces of the arch-shaped bodies, and the sound waves transmitted from the sound wave transmitter may be mixed with the propagation sound waves so that the propagation sound waves become difficult to hear outside the space.

The sound insulation apparatus according to the first aspect of the present invention is able to make speeches or details of a conversation in the space difficult to hear outside the space, as well as can be easily installed at low cost.

According to the second aspect of the present invention, the speeches propagating out of the space are masked.

According to the third aspect of the present invention, the speeches propagating out of the space are further masked.

According to the fourth aspect of the present invention, the speeches are easy to hear inside the space, whereas the speeches propagating out of the space become difficult to hear outside the space.

According to the fifth aspect of the present invention, the speeches propagating out of the space become more difficult to hear outside the space.

According to the sixth aspect of the present invention, a plane-shaped sound insulation wall is formed using masking sounds in the space.

According to the seventh aspect of the present invention, a planar sound insulation wall is formed using masking sounds above the space.

According to the eighth aspect of the present invention, a dome-shaped sound insulation wall is formed using masking sounds in the space.

According to the ninth aspect of the present invention, a planar sound insulation wall is formed using masking sounds on the sides of the space.

DESCRIPTION OF EMBODIMENTS

Figure 1A:
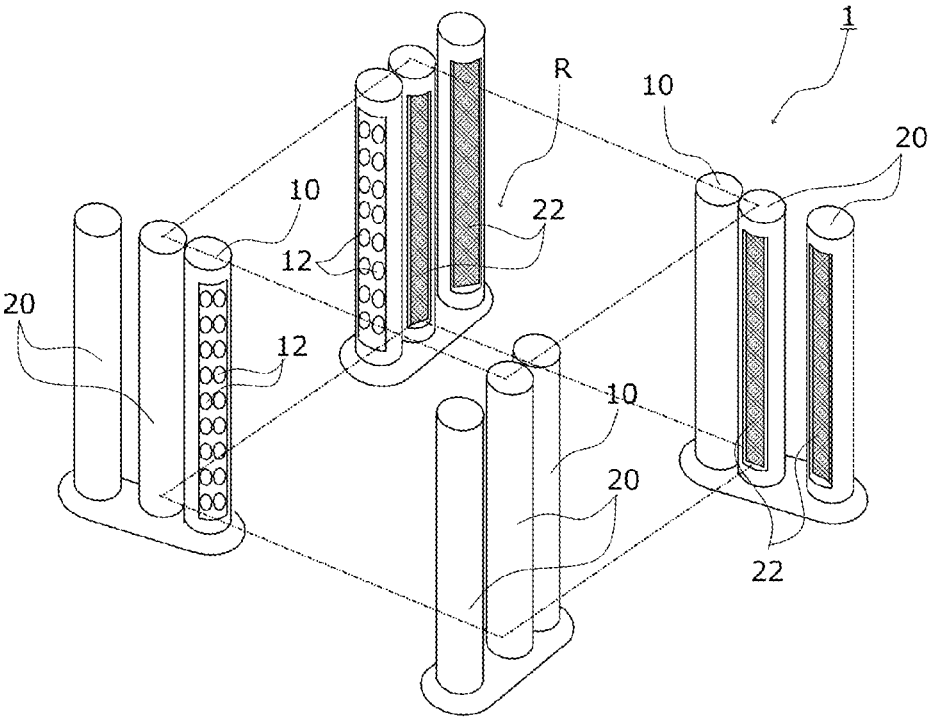
FIG. 1A is a perspective view showing an example of a space to which a sound insulation apparatus according to a first embodiment is applied.

Referring now to the drawings, embodiments and specific examples of the present invention will be described in detail. However, the present invention is not limited to the embodiments or specific examples. Also, the drawings are schematic, and elements other than those required for the description are omitted therein as appropriate to clarify the description.

First Embodiment (1) Configuration of Sound Insulation Apparatus

Figure 1B:
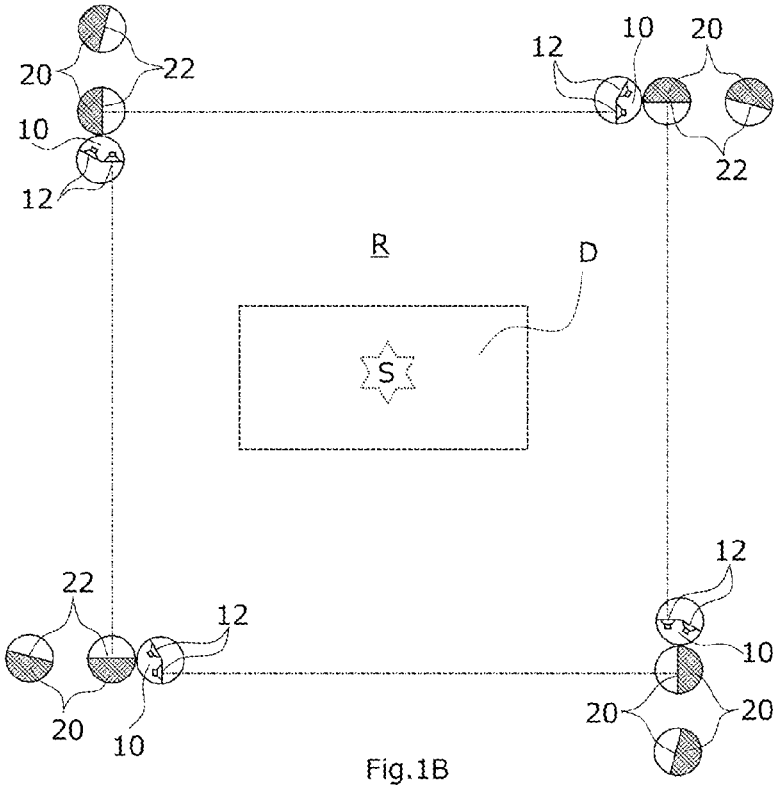
FIG. 1B is a schematic plan view of the space shown in FIG. 1A.
Figure 2A:
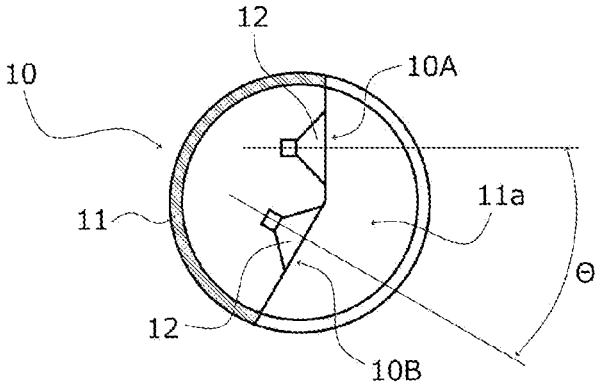
FIG. 2A is a schematic cross-sectional view showing the internal configuration of a sound wave transmitter.
Figure 2B:
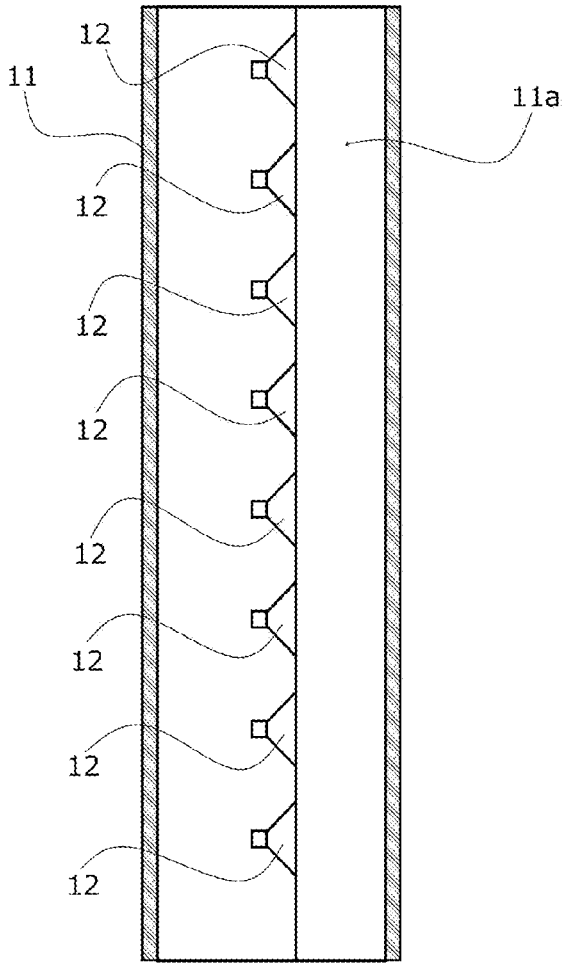
FIG. 2B is a schematic longitudinal sectional view.
Figure 3A:
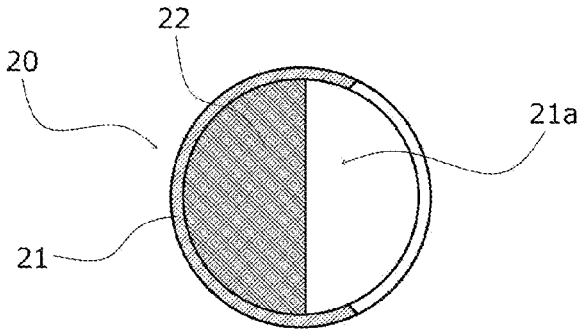
FIG. 3A is a schematic cross-sectional view showing the internal configuration of a sound wave receiver.
Figure 3B:
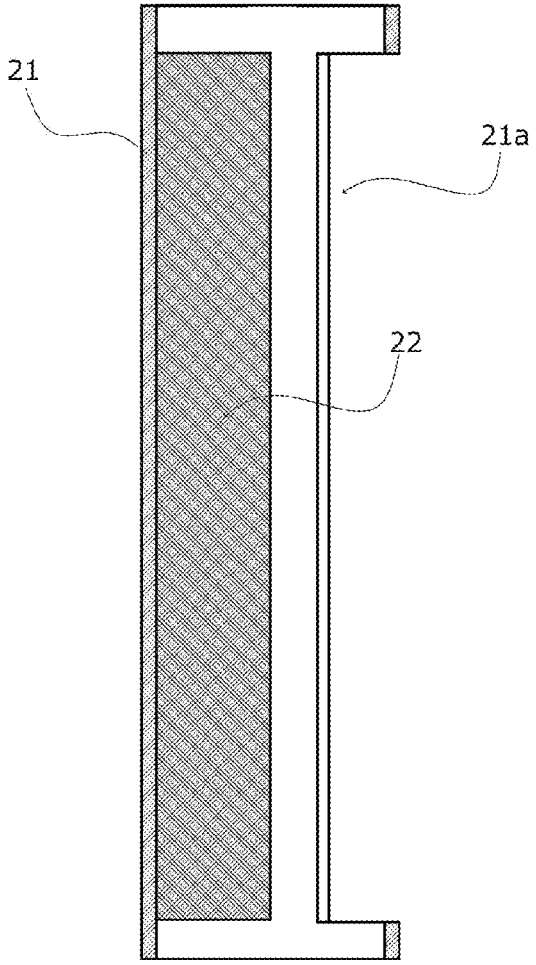
FIG. 3B is a schematic longitudinal sectional view.
Figure 4A:
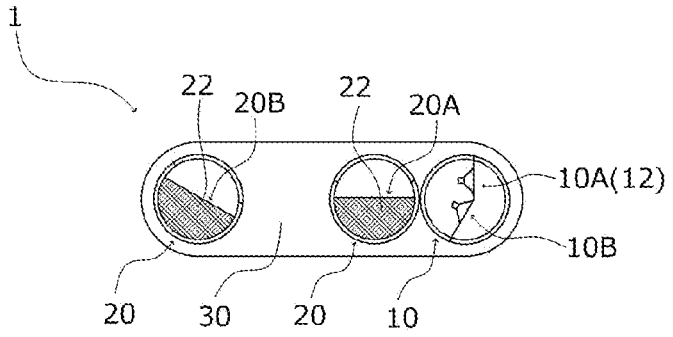
FIG. 4A is a schematic cross-sectional view showing the sound wave transmitter and sound wave receiver coupled so as to form one pair set.
Figure 4B:
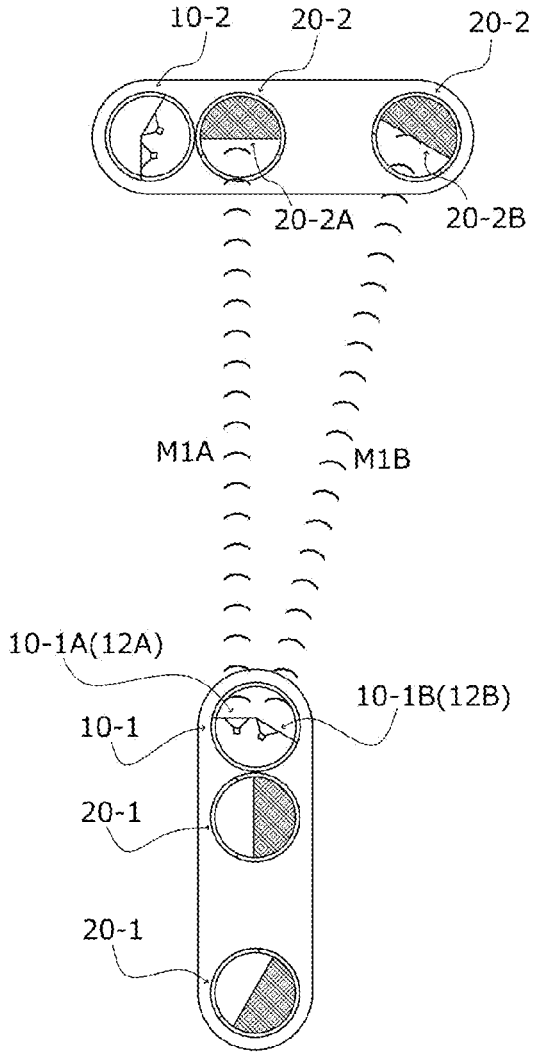
FIG. 4B is a schematic plan view showing a state in which the sound wave transmitter and sound wave receiver coupled so as to form the one pair set and a sound wave transmitter and a sound wave receiver forming another set are spaced from and opposed to each other.

FIG. 1A is a perspective view showing an example of a space to which a sound insulation apparatus according to a first embodiment is applied, and FIG. 1B is a schematic plan view of the space shown in FIG. 1A. FIG. 2A is a schematic cross-sectional view showing the internal configuration of a sound wave transmitter, and FIG. 2B is a schematic longitudinal sectional view. FIG. 3A is a schematic cross-sectional view showing the internal configuration of a sound wave receiver, and FIG. 3B is a schematic longitudinal sectional view. FIG. 4A is a schematic cross-sectional view showing the sound wave transmitter and sound wave receiver coupled so as to form one pair set, and FIG. 4B is a schematic plan view showing a state in which the sound wave transmitter and sound wave receiver coupled so as to form the one pair set and a sound wave transmitter and a sound wave receiver forming another set are spaced from and opposed to each other. The sound insulation apparatus according to the present embodiment will be described below with reference to the drawings.

As shown in FIGS. 1A and 1B, in a sound insulation apparatus 1, a sound wave transmitter 10 that transmits sound waves with frequencies including the frequencies of propagation sound waves SA (see FIG. 5) from a sound source S and a sound wave receiver 20 that receives the sound waves transmitted from the sound wave transmitter 10 are coupled such that the orientations of sound wave transmission surfaces 10A and 10B of the sound wave transmitter 10 and the orientations of sound wave receiving surfaces 20A and 20B of the sound wave receivers 20 (see FIG. 4A) intersect each other and one pair set is formed. The one pair set is disposed in plurality so as to form a space R (shown by a two-dot chain line in FIG. 1B) surrounding the sound source S.

As shown by a two-dot chain line in FIG. 1B, an example of the space R surrounded by the sound insulation apparatus 1 is a conversation space in which a desk D is installed and meetings, business negotiations, preliminary meetings, or the like are held. In this space R, a person who produces speeches serves as the sound source S and produces propagation sound waves SA with frequencies of around 100 to 5000 HZ as speech sounds. In the sound insulation apparatus 1 according to the present embodiment, each sound wave transmitter 10 transmits sound waves with frequencies including the frequencies of the propagation sound waves SA toward a corresponding sound wave receiver 20 so that the sound waves are mixed with the speech sounds. Thus, outside the space R, the speech sounds become difficult to hear, or details of the conversation become ambiguous.

As shown in FIGS. 2A and 2B, each sound wave transmitter 10 includes a columnar body 11 and multiple speakers 12 disposed inside the columnar body 11. The body 11 is a columnar body whose height from the floor on which the sound insulation apparatus 1 is disposed is approximately equal to the required height of the space R, for example, 1500 mm to 2000 mm, and whose diameter is a size that allows the body to house the speakers 12, for example, 100 mm to 150 mm. The material of the body 11 may be any of a metal, a resin, wood, or the like.

Each speaker 12 is a super-directional speaker that converts masking sound signals supplied from an oscillation circuit/amplifier circuit (not shown) into sound waves and emits masking sounds using ultrasound as a carrier wave. As shown in FIG. 2B, the body 11 has an opening 11*a* on one surface, and the speakers 12 are arranged along the length direction (height direction) of the body 11 in the opening 11*a*. Thus, a planar sound insulation wall consisting of masking sounds is formed in the space R.

As shown in FIG. 2A, the speakers 12 are disposed so as to form an angle (see Θ in FIG. 2A) so that the emission directions of masking sounds intersect each other in a plan view. The speakers 12 form the sound wave transmission surfaces 10A and 10B of the sound wave transmitter 10 and, as will be described later, transmit masking sounds (see M1A and M1B in FIG. 4B) to the spaced sound wave receiving surfaces 20A and 20B of the sound wave receivers 20 spaced from and opposed to the sound wave transmitter 10. Thus, the speech sounds propagating out of the space R become difficult to hear.

As shown in FIGS. 3A and 3B, each sound wave receiver 20 includes a columnar body 21 and a sound absorbing material 22 disposed inside the body 21. The body 21 is a columnar body whose height is approximately the same as that of the body 11 of the opposite sound wave transmitter 10, for example, 1500 mm to 2000 mm and whose diameter is, for example, 100 mm to 150 mm. The material of the body 21 may be any of a metal, a resin, wood, or the like.

As shown in FIG. 3B, the body 21 has an opening 21*a* on one surface, and the sound absorbing material 22 is disposed along the length direction (height direction) of the body 21 in the opening 21*a*. The sound absorbing material 22 is a material that is able to absorb masking sounds emitted from the speakers 12 to some extent and is, for example, any material that attenuates the energy of sounds when the sounds pass through the material, such as glass wool, rock wool, urethane foam, felt, asbestos board, or wood wool board. By disposing such a sound absorbing material 22 along the opening 21*a* of the body 21, the sound waves transmitted from the speakers 12 are absorbed by the sound absorbing material 22 and a planar sound insulation wall is formed in the space R.

The sound wave transmitter 10 and sound wave receiver 20 thus configured are coupled by a support frame 30 such that the orientations of the sound wave transmission surfaces 10A and 10B of the sound wave transmitter 10 and the orientations of the sound wave receiving surfaces 20A and 20B of the two sound wave receivers 20 intersect each other and one pair set is formed. Specifically, as shown in FIG. 4A, the sound wave transmitter 10 and the sound wave receiver 20 adjacent to the sound wave transmitter 10 are disposed such that the orientation of the sound wave transmission surface 10A of the sound wave transmitter 10 and the orientation of the sound wave receiving surface 20A of the sound wave receiver 20 are approximately perpendicular to each other, and the sound wave transmitter 10 and the sound wave receiver 20 spaced from the sound wave transmitter 10 are disposed such that the orientation of the sound wave transmission surface 10B of the sound wave transmitter 10 and the orientation of the sound wave receiving surface 20B of the sound wave receiver 20 are approximately perpendicular to each other.

As shown in FIG. 4B, a sound wave transmitter 10-1 and sound wave receivers 20-1 forming one pair set are spaced from and opposed to a sound wave transmitter 10-2 and sound wave receivers 20-2 forming another set, and the masking sounds emitted from the sound wave transmitter 10-1 of the one set are received by the sound wave receivers 20-2 of the other set. Specifically, sound waves M1A (see M1A shown by solid lines in FIG. 4B) transmitted from a sound wave transmission surface 10-1A (speakers 12A) of the sound wave transmitter 10-1 of the one set are received by a sound wave receiver 20-2A of the other set spaced from and opposed to the sound wave transmitter 10-1, and sound waves M1B (see M1B shown by solid lines in FIG. 4B) transmitted from a sound wave transmission surface 10-1B (speakers 12B) are received by a sound wave receiver 20-2B.

(2) Functions of Sound Insulation Apparatus

Figure 5:
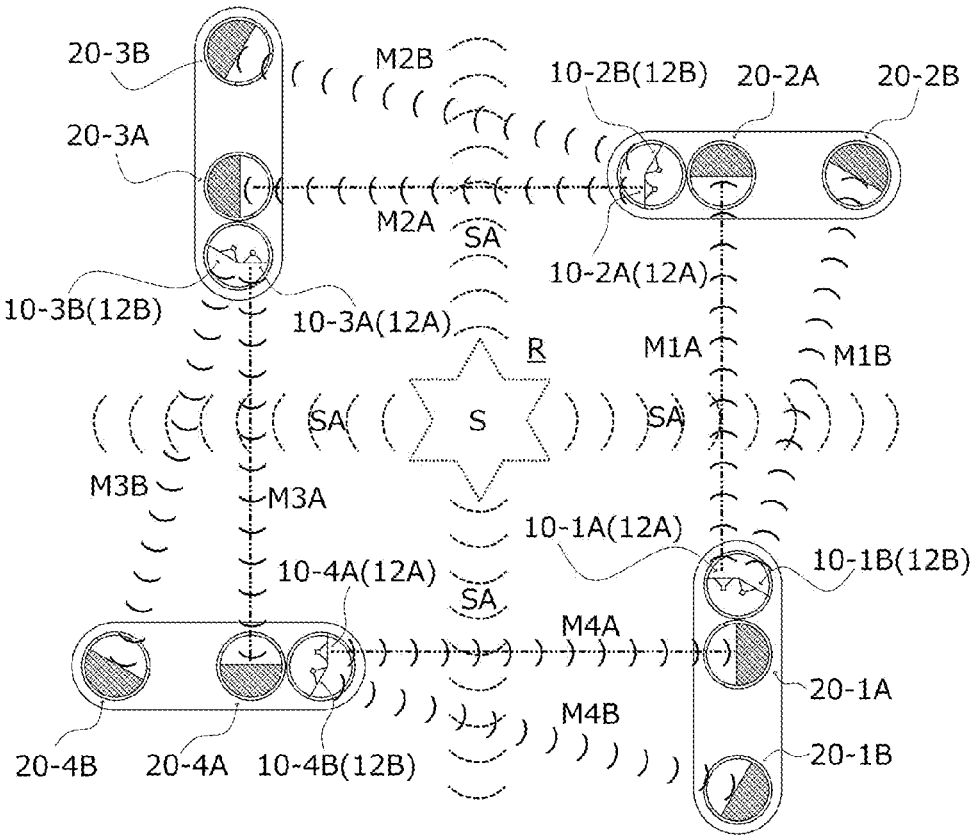
FIG. 5 is a schematic plan view showing the sound insulation apparatus in which the sound wave transmitter and sound wave receiver forming the one pair set is disposed in plurality so as to form a space surrounding a sound source.

FIG. 5 is a schematic plan view showing the sound insulation apparatus 1 in which the sound wave transmitter 10 and the sound wave receiver forming the one pair set are disposed in plurality so as to form a space R (shown by a two-dot chain line in FIG. 5) surrounding the sound source S. As shown in FIG. 5, in the sound insulation apparatus 1, the sound wave transmitter 10 and sound wave receiver 20 forming the one pair set are disposed in plurality so as to be spaced from and opposed to each other such that the sound waves M as masking sounds emitted from the sound wave transmitter 10 of one set are received by the sound wave receiver 20 of another set.

In FIG. 5, sound waves M1A (see M1A shown by solid lines in FIG. 5) transmitted from the sound wave transmission surface 10-1A (speakers 12A) of the sound wave transmitter 10-1 of one set are received by the sound wave receiver 20-2A of another set spaced from and opposed to the sound wave transmitter 10-1, and sound waves M1B transmitted from the sound wave transmission surface 10-1B (speakers 12B) are received by the sound wave receiver 20-2B. While some of speech sounds emitted from the sound source S (shown by a broken line in FIG. 5) in the space R (shown by a two-dot chain line in FIG. 5) propagate toward the outside of the space R as propagation sound waves SA (see SA shown by broken lines in FIG. 5), the speech sounds are mixed with the sound waves M1A transmitted from the sound wave transmission surface 10-1A (speakers 12A) of the sound wave transmitter 10-1 and the sound waves M1B transmitted from the sound wave transmission surface 10-1B (speakers 12B) and thus become ambiguous and difficult to hear outside the space R.

Also, as shown in FIG. 5, sound waves M2A transmitted from the sound wave transmission surface 10-2A (speakers 12A) of the sound wave transmitter 10-2 of the other set are received by a sound wave receiver 20-3A of still another set spaced from and opposed to the sound wave transmitter 10-2, and sound waves M2B transmitted from a sound wave transmission surface 10-2B (speakers 12B) are received by a sound wave receiver 20-3B. While some of speech sounds emitted from the sound source S in the space R propagate toward the outside of the space R as propagation sound waves SA, the speech sounds are mixed with the sound waves M2A and sound waves M2B and become ambiguous and difficult to hear outside the space R.

Similarly, as shown in FIG. 5, sound waves M3A transmitted from a sound wave transmission surface 10-3A (speakers 12A) of a sound wave transmitter 10-3 of the still other set are received by a sound wave receiver 20-4A of yet another set spaced from and opposed to the sound wave transmitter 10-3, and sound waves M3B transmitted from a sound wave transmission surface 10-3B (speakers 12B) are received by a sound wave receiver 20-4B. While some of speech sounds emitted from the sound source S in the space R propagate toward the outside of the space R as propagation sound waves SA, the speech sounds are mixed with the sound waves M3A and sound waves M3B and become ambiguous and difficult to hear outside the space R.

Also, as shown in FIG. 5, sound waves M4A transmitted from a sound wave transmission surface 10-4A (speakers 12A) of the sound wave transmitter 10-4 of the yet other set are received by the sound wave receiver 20-1A of the one set spaced from and opposed to the sound wave transmitter 10-4, and sound waves M4B transmitted from a sound wave transmission surface 10-4B (speakers 12B) are received by the sound wave receiver 20-1B. While some of speech sounds emitted from the sound source S in the space R propagate toward the outside of the space R as propagation sound waves SA, the speech sounds are mixed with the sound waves M4A and sound waves M4B and become ambiguous and difficult to hear outside the space R.

In the present embodiment, the sound wave receiver 20-2B is located outside the space R with respect to the sound wave receiver 20-2A. For this reason, the sound waves M1B transmitted from the sound wave transmission surface 10-1B (speakers 12B) travel toward the outside of the space R, and the propagation direction of the sound wave M1B overlaps that of some of the propagation sound waves SA, resulting in an increase in the affinity between the propagation sound waves SA and the sound waves M1B, which are masking sounds. Thus, the propagation sound waves SA and the sound waves M1B, which are masking sounds, are perceived as fused sound waves outside the space R, that is, the speech sounds from inside the space R become more difficult to hear.

Similarly, the propagation directions of the sound waves M2B transmitted from the sound wave transmitter 10-2B of the other set surrounding the space R and received by the sound wave receiver 20-3B of the still other set, the sound waves M3B transmitted from the sound wave transmitter 10-3B of the still other set and received by the sound wave receiver 20-4B of the yet other set, and the sound waves M4B transmitted from the sound wave transmitter 10-4B of the yet other set and received by the sound wave receiver 20-1B of the one set also overlap those of some of the propagation sound waves SA, resulting in increases in the affinity between the propagation sound waves SA and the sound waves M2B, M3B, and M4B, which are masking sounds. Thus, in the sound insulation apparatus 1 according to the present embodiment, the propagation sound waves SA and the sound waves M1B, M2B, M3B, and M4B, which are masking sounds, are perceived as fused sound waves outside the space R, that is, the speech sounds in the space R become more difficult to hear.

As seen above, in the sound insulation apparatus 1 according to the present embodiment, the sound wave transmitter 10 and sound wave receiver 20 are coupled such that the orientations of the sound wave transmission surfaces 10A and 10B of the sound wave transmitter 10 and the orientations of the sound wave receiving surfaces 20A and 20B of the sound wave receivers 20 intersect each other and one pair set is formed, and the one pair set is disposed at the four corners to form the space R surrounding the sound source S. This sound insulation apparatus is able to make speeches or details of a conversation in the space R difficult to hear outside the space R, as well as can be easily installed at low cost.

Modification 1

Figure 6:
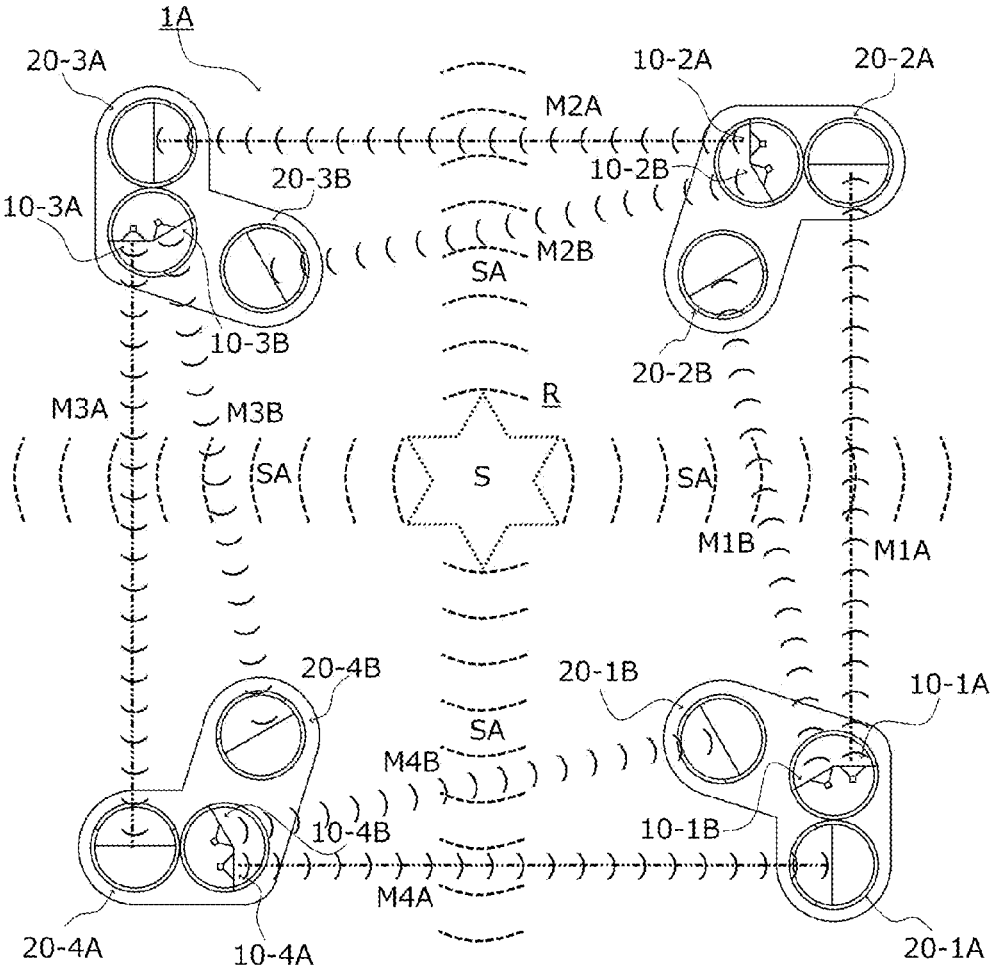
FIG. 6 is a schematic plan view showing a sound insulation apparatus according to a modification 1 in which a sound wave transmitter and a sound wave receiver forming one pair set is disposed in plurality so as to form a space surrounding a sound source.

FIG. 6 is a schematic plan view showing a sound insulation apparatus 1A according to a modification 1 in which a sound wave transmitter 10 and a sound wave receiver 20 forming one pair set are disposed in plurality so as to form a space R surrounding a sound source S. As shown in FIG. 6, in the sound insulation apparatus 1A according to the modification 1, a sound wave receiver 20-2B is located inside the space R (shown by a two-dot chain line in FIG. 6) with respect to a sound wave receiver 20-2A, and sound waves M1B (see M1B shown by solid lines in FIG. 6) transmitted from a sound wave transmission surface 10-1B travel toward the inside of the space R. For this reason, the propagation direction of the sound waves M1B overlaps that of some of propagation sound waves SA in the space R, resulting in an increase in the affinity between the propagation sound waves SA (see SA shown by broken lines in FIG. 6) and the sound waves M1B, which are masking sounds. Thus, the sound waves M1B, which are masking sounds, make the speech sounds produced in the space R difficult to leak out of the space R.

Similarly, as shown in FIG. 6, the propagation directions of sound waves M2B transmitted from a sound wave transmitter 10-2B of another set surrounding the space R and received by a sound wave receiver 20-3B of still another set located inside the space R, sound waves M3B transmitted from a sound wave transmitter 10-3B of the still other set and received by a sound wave receiver 20-4B of yet another set located inside the space R, and sound waves M4B transmitted from a sound wave transmitter 10-4B of the yet other set and received by a sound wave receiver 20-1B of the one set located inside the space R also overlap those of some of propagation sound waves SA, resulting in increases in the affinity between the propagation sound waves SA and the sound waves M2B, M3B, and M4B, which are masking sounds. Thus, the sound waves M1B, M2B, M3B, and M4B, which are masking sounds, make the speech sounds produced in the space R difficult to leak out of the space R.

Modification 2

Figure 7A:
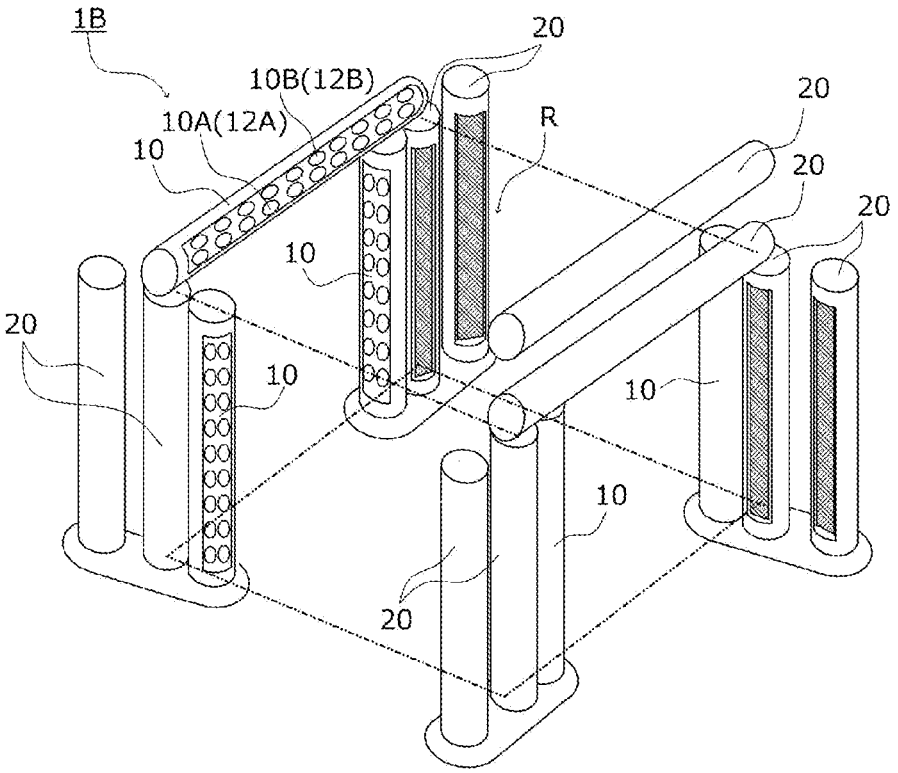
FIG. 7A is a perspective view showing an example of a space to which a sound insulation apparatus according to a modification 2 is applied.
Figure 7B:
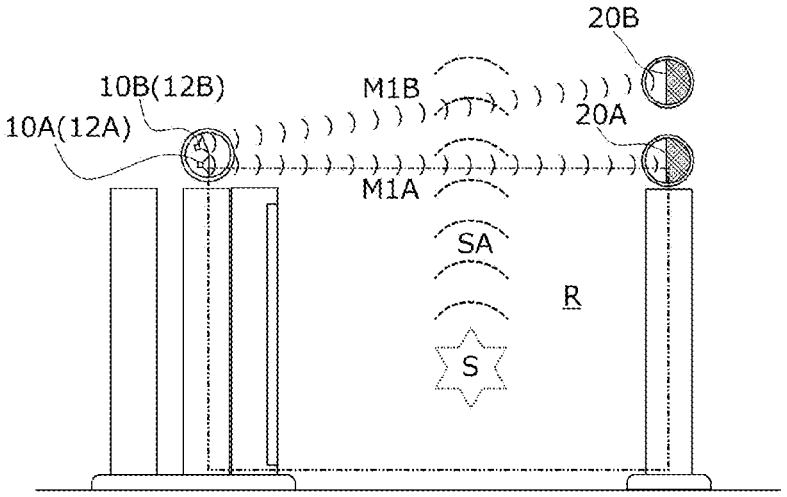
FIG. 7B is a schematic side view of the space shown in FIG. 7A.

FIG. 7A is a perspective view showing an example of a space to which a sound insulation apparatus 1B according to a modification 2 is applied, and FIG. 7B is a schematic side view of the space shown in FIG. 7A. As shown in FIG. 7, in the sound insulation apparatus 1B according to the modification 2, a sound wave transmitter 10 that transmits sound waves with frequencies including the frequencies of propagation sound waves SA from a sound source S and a sound wave receiver 20 that receives the sound waves transmitted from the sound wave transmitter 10 are coupled such that the orientation of the sound wave transmission surface of the sound wave transmitter 10 and the orientation of the sound wave receiving surface of the sound wave receiver 20 intersect each other and one pair set is formed. The one pair set is disposed in plurality so as to form a space R surrounding the sound source S. The sound wave transmitter 10 and sound wave receiver 20 are further disposed above the space R so as to be opposed to each other and cover the space R.

As shown in FIG. 7B, sound waves M1A transmitted from a sound wave transmission surface 10A (speakers 12A) of the sound wave transmitter 10 above the space R are received by a sound wave receiver 20A spaced from and opposed to the sound wave transmitter 10, and sound waves M1B (see M1B shown by solid lines in FIG. 7B) transmitted from a sound receiving surface 10B (speakers 12B) are received by a sound wave receiver 20B. While some of speech sounds emitted from the sound source S in the space R (shown by a two-dot chain line in FIG. 7B) propagate out of an upper portion of the space R as propagation sound waves SA (see SA shown by broken lines in FIG. 7B), the speech sounds are mixed with the sound waves M1A transmitted from the sound wave transmission surface 10A (speakers 12A) of the sound wave transmitter 10 and the sound waves M1B transmitted from the sound wave transmission surface 10B (speakers 12B) and thus become ambiguous and difficult to hear outside the space R. Even if such propagation sound waves SA propagate outside the space R so as to travel toward the ceiling or the like from the upper portion of the space R and be reflected by the ceiling, they remain ambiguous and difficult to hear.

Second Embodiment

Figure 8A:
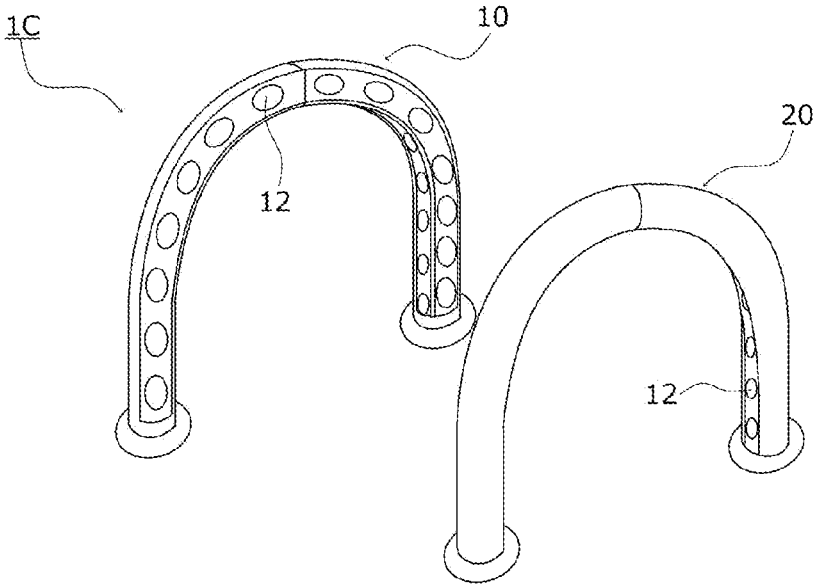
FIG. 8A is a perspective view showing an example of a space to which a sound insulation apparatus according to a second embodiment is applied and focusing on a sound wave transmitter.
Figure 8B:
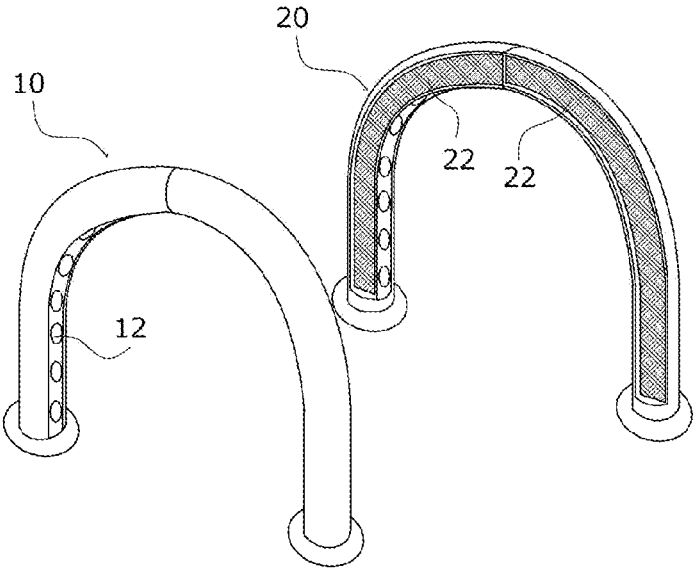
FIG. 8B is a perspective view focusing on a sound wave receiver.
Figure 9A:
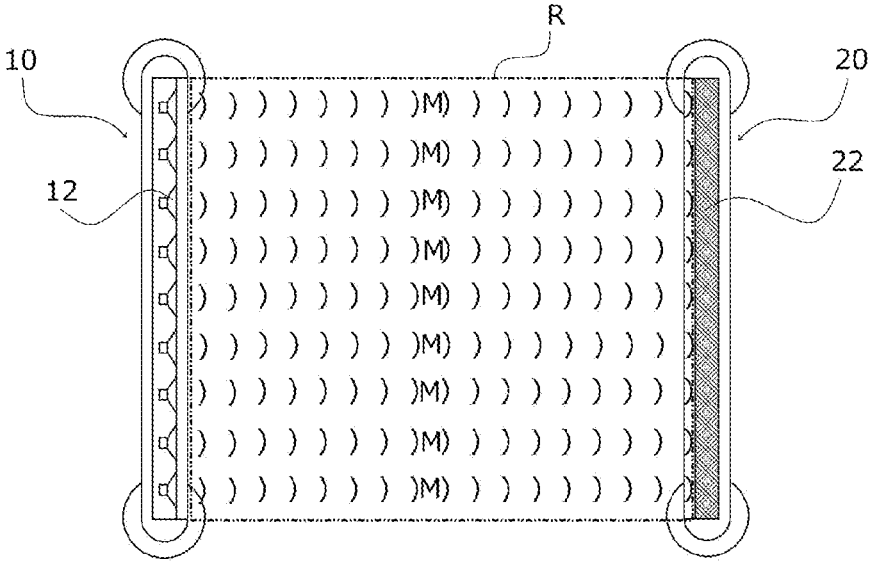
FIG. 9A is a schematic plan view showing travel of sound waves transmitted from the arch-shaped sound wave transmitter 10 toward the arch-shaped sound wave receiver 20 opposed to the sound wave transmitter 10.
Figure 9B:
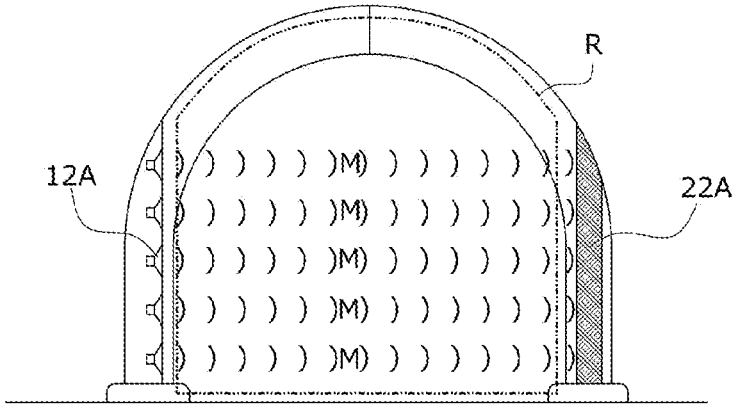
FIG. 9B is a schematic side view showing travel of sound waves inside the arc-shaped bodies

FIG. 8A is a perspective view showing an example of a space to which a sound insulation apparatus 1C according to a second embodiment is applied and focusing on a sound wave transmitter, and FIG. 8B is a perspective view focusing on a sound wave receiver. FIG. 9A is a schematic plan view showing travel of sound waves transmitted from the arch-shaped sound wave transmitter 10 toward the arch-shaped sound wave receiver 20 opposed to the sound wave transmitter 10, and FIG. 9B is a schematic side view showing travel of sound waves inside the arc-shaped bodies.

As shown in FIGS. 8A and 8B, in the sound insulation apparatus 1C, the sound wave transmitter 10 and sound wave receiver 20 are arc-shaped bodies that are curved in a direction intersecting the travel direction of the sound waves. Multiple super-directional speakers 12 that output sound waves M using ultrasound as a carrier wave are arranged in the sound wave transmitter 10 along the curved direction of the arch-shaped body. A sound absorbing material 22 is embedded in the sound wave receiver 20 along the curved direction of the arch-shaped body.

As shown in FIG. 9A, the arch-shaped bodies are disposed so as to be opposed to each other. The sound waves M transmitted from the super-directional speakers 12 of one of the arch-shaped bodies travel so as to be absorbed by the sound absorbing material 22 embedded in the other arch-shaped body. Speech sounds as propagation sound waves SA produced in the space R (shown by a two-dot chain line in FIGS. 9A and 9B) are mixed with the sound waves M as masking sounds between the arch-shaped bodies and thus become difficult to hear outside the space R.

Further, multiple super-directional speakers 12A for outputting sound waves M using ultrasound as a carrier wave are arranged on one side of the radially curved inner surface of each arch-shaped body. Also, a sound absorbing material 22A for absorbing sound waves M transmitted from the super-directional speakers 12A is embedded on the other side of the radially curved inner surface.

As shown in FIG. 9B, sound waves M (see M shown by solid lines in FIG. 9B) transmitted from the super-directional speakers 12A disposed on one side of the radially curved inner surface of each arch-shaped body travel toward the sound absorbing material 22A disposed on the other side of the radially curved inner surface of the arch-shaped body. Thus, speech sounds as propagation sound waves SA produced in the space R (shown by a two-dot chain line in FIGS. 9A and 9B) are mixed with the sound waves M as masking sounds and become difficult to hear outside the space R.

As seen above, according to the present embodiment, the arch-shaped sound wave transmitter 10 that transmits sound waves with frequencies including the frequencies of propagation sound waves SA from the sound source S and the arch-shaped sound wave receiver 20 that receives the sound waves M transmitted from the sound wave transmitter 10 are opposed to each other and form the space R surrounding the sound source S. Thus, the space R can be used as a conversation space for holding meetings, business negotiations, preliminary meetings, or the like. While speech sounds produced in the conversation space act as propagation sound waves SA that propagate out of the space R, they are mixed with sound waves M as masking sounds and thus become difficult to hear outside the space R.

DENOTATION OF REFERENCE NUMERALS

1,1A,1B,1C sound insulation apparatus
10 sound wave transmitter
10A,10B sound wave transmission surfaces
11 columnar body
12,12A,12B speakers
20 sound wave receiver
20A,20B sound wave receiving surfaces
21 body
22 sound absorbing material
M,M1A,M1B,M2A,M2B,M3A,M3B,M4A,M4B sound waves
R space
S sound source
SA propagation sound waves

What is claimed is:

1. A sound insulation apparatus, wherein a sound wave transmitter configured to transmit sound waves with frequencies including the frequencies of propagation sound waves from a sound source and a sound wave receiver configured to receive the sound waves transmitted from the sound wave transmitter are coupled such that the orientation of a sound wave transmission surface of the sound wave transmitter and the orientation of a sound wave receiving surface of the sound wave receiver intersect each other and one pair set is formed, and wherein the one pair set is disposed in plurality such that the sound wave transmission surface of one set is spaced from and opposed to the sound wave receiving surface of another set and a space surrounding the sound source is formed.

2. The sound insulation apparatus according to claim 1, wherein the one pair set disposed in plurality is disposed such that the sound wave transmission surface of one set is spaced from and opposed to the sound wave receiving surface of another set, and wherein the sound waves transmitted from each of the sound wave transmitters are mixed with the propagation sound waves so that the propagation sound waves become difficult to hear outside the space.

3. The sound insulation apparatus according to claim 2, wherein the sound wave receiver is disposed in plurality so as to be spaced from each other, and wherein a plurality of sound wave transmission surfaces form an angle in the sound wave transmitter so as to intersect each other so that the sound wave transmitter transmits the sound waves to the sound wave receiving surfaces of the sound wave receivers opposed to the sound wave transmitter.

4. The sound insulation apparatus according to claim 2, wherein the sound wave transmitter and the sound wave receiver are columnar bodies extending in a direction intersecting the travel directions of the sound waves, and wherein a plurality of super-directional speakers configured to output the sound waves using ultrasound as a carrier wave are arranged in the sound wave transmitter along the length direction of the columnar body.

5. The sound insulation apparatus according to claim 2, wherein the sound wave transmitter and the sound wave receiver are further disposed above the space so as to be opposed to each other and cover the space.

6. The sound insulation apparatus according to claim 1, wherein the sound wave receiver is disposed in plurality so as to be spaced from each other, and wherein a plurality of sound wave transmission surfaces form an angle in the sound wave transmitter so as to intersect each other so that the sound wave transmitter transmits the sound waves to the sound wave receiving surfaces of the sound wave receivers opposed to the sound wave transmitter.

7. The sound insulation apparatus according to claim 6, wherein one of the sound wave receivers spaced from each other is disposed outside the space with respect to the other sound wave receiver.

8. The sound insulation apparatus according to claim 7, wherein the sound wave transmitter and the sound wave receiver are columnar bodies extending in a direction intersecting the travel directions of the sound waves, and wherein a plurality of super-directional speakers configured to output the sound waves using ultrasound as a carrier wave are arranged in the sound wave transmitter along the length direction of the columnar body.

9. The sound insulation apparatus according to claim 7, wherein the sound wave transmitter and the sound wave receiver are further disposed above the space so as to be opposed to each other and cover the space.

10. The sound insulation apparatus according to claim 6, wherein one of the sound wave receivers spaced from each other is disposed inside the space with respect to the other sound wave receiver.

11. The sound insulation apparatus according to claim 10, wherein the sound wave transmitter and the sound wave receiver are columnar bodies extending in a direction intersecting the travel directions of the sound waves, and wherein a plurality of super-directional speakers configured to output the sound waves using ultrasound as a carrier wave are arranged in the sound wave transmitter along the length direction of the columnar body.

12. The sound insulation apparatus according to claim 10, wherein the sound wave transmitter and the sound wave receiver are further disposed above the space so as to be opposed to each other and cover the space.

13. The sound insulation apparatus according to claim 6, wherein the sound wave transmitter and the sound wave receiver are columnar bodies extending in a direction intersecting the travel directions of the sound waves, and wherein a plurality of super-directional speakers configured to output the sound waves using ultrasound as a carrier wave are arranged in the sound wave transmitter along the length direction of the columnar body.

14. The sound insulation apparatus according to claim 6, wherein the sound wave transmitter and the sound wave receiver are further disposed above the space so as to be opposed to each other and cover the space.

15. The sound insulation apparatus according to claim 1, wherein the sound wave transmitter and the sound wave receiver are columnar bodies extending in a direction intersecting the travel directions of the sound waves, and wherein a plurality of super-directional speakers configured to output the sound waves using ultrasound as a carrier wave are arranged in the sound wave transmitter along the length direction of the columnar body.

16. The sound insulation apparatus according to claim 15, wherein the sound wave transmitter and the sound wave receiver are further disposed above the space so as to be opposed to each other and cover the space.

17. The sound insulation apparatus according to claim 1, wherein the sound wave transmitter and the sound wave receiver are further disposed above the space so as to be opposed to each other and cover the space.

18. A sound insulation apparatus, wherein a sound wave transmitter configured to transmit sound waves with frequencies including the frequencies of propagation sound waves from a sound source and a sound wave receiver configured to receive the sound waves transmitted from the sound wave transmitter are disposed so as to be opposed to each other and form a space surrounding the sound source, wherein the sound wave transmitter and the sound wave receiver are arch-shaped bodies curved in a direction intersecting the travel directions of the sound waves, and wherein a plurality of super-directional speakers configured to output the sound waves using ultrasound as a carrier wave are arranged in the sound wave transmitter along the curved direction of the arch-shaped body.

19. The sound insulation apparatus according to claim 18, wherein a plurality of super-directional speakers configured to output the sound waves using ultrasound as a carrier wave are arranged on radially curved inner surfaces of the arch-shaped bodies, and wherein the sound waves transmitted from the sound wave transmitter are mixed with the propagation sound waves so that the propagation sound waves become difficult to hear outside the space.

* * * * *